United States Patent [19]

Shen et al.

[11] Patent Number: 4,659,087

[45] Date of Patent: Apr. 21, 1987

[54] CASINO GAME

[76] Inventors: Margaret Shen; Barry R. Forrester, both of 21 Bent Street, Sydney, New South Wales, 2000, Australia

[21] Appl. No.: 806,647

[22] Filed: Dec. 9, 1985

[51] Int. Cl.[4] ..... A63F 1/00

[52] U.S. Cl. ..... 273/274; 273/292

[58] Field of Search ..... 273/274, 292

[56] References Cited

PUBLICATIONS

"Scarne's New Complete Guide to Gambling" by John Scarne, pub. by Simon & Schuster, New York, copyright 1961, 1974, pp. 463–474.

*Primary Examiner*—Anton O. Oechsle

*Attorney, Agent, or Firm*—Larson and Taylor

[57] ABSTRACT

A casino card game for a number of players which is played on a table which includes a station for the House and a number player stations adjacent thereto, each of which stations has positions for two pairs of cards and the player stations having a position for bet made by the player, the game being one in which each player is dealt four cards which the player has to make into two groups of two having a highest value, the value being achieved either by adding the face value of the cards, with the court card having a nominated face value of ten and disregarding the ten digit should there be one, each player playing against the bank, the player having a winning hand, if both of his pairs are higher than both of the bank pairs, a losing hand, if both is his pairs are lower than both of the bank's pairs and a stand-off, if one pair is lower and one pair is higher than the bank's pairs.

8 Claims, 2 Drawing Figures

CASINO GAME

This invention relates to a card game and, in particular, to a card game which can be particularly suitable for use in casinos; and to a table for the playing of the game.

There are many card games which can be used for gambling purposes but, often, these are relatively complicated and difficult to learn for a relatively unskilled person.

Possibly, the exception to this is Blackjack or Twenty-One, as it is known in some areas, and which, because of its overall simplicity, is a universally played casino game.

Whilst Blackjack is quite a satisfactory game, it is desirable, in our opinion, that casinos be able to offer alternate games and it is to provide such an alternate game, which is relatively simple to play, that the present invention relates.

The invention includes, in its broadest sense, a card game for a number of players substantially as described hereinafter, in which each player is dealt four cards which the player has to make into two groups of two having a highest value, the value being achieved either by adding the face value of the cards, with the court cards having a nominated face value of ten, and disregarding the ten digit should there be one, each player playing against the bank, the player having a winning hand, if both of his pairs are higher than both of the bank pairs, a losing hand, if both of his pairs are lower than both of the bank pairs, and reaching a stand-off if one pair is lower and one pair higher than the bank pairs.

The bank may be the House or another player.

The invention also includes a table upon which such a game can be played including a station for the House and up to seven player stations, which stations have positions for the pairs of cards and for a bet made by the player.

In order that the invention may be more readily understood, we shall describe one form of table, in association with the accompanying drawings, and set out hereinafter what are, effectively, the rules of the game.

Figure 1:
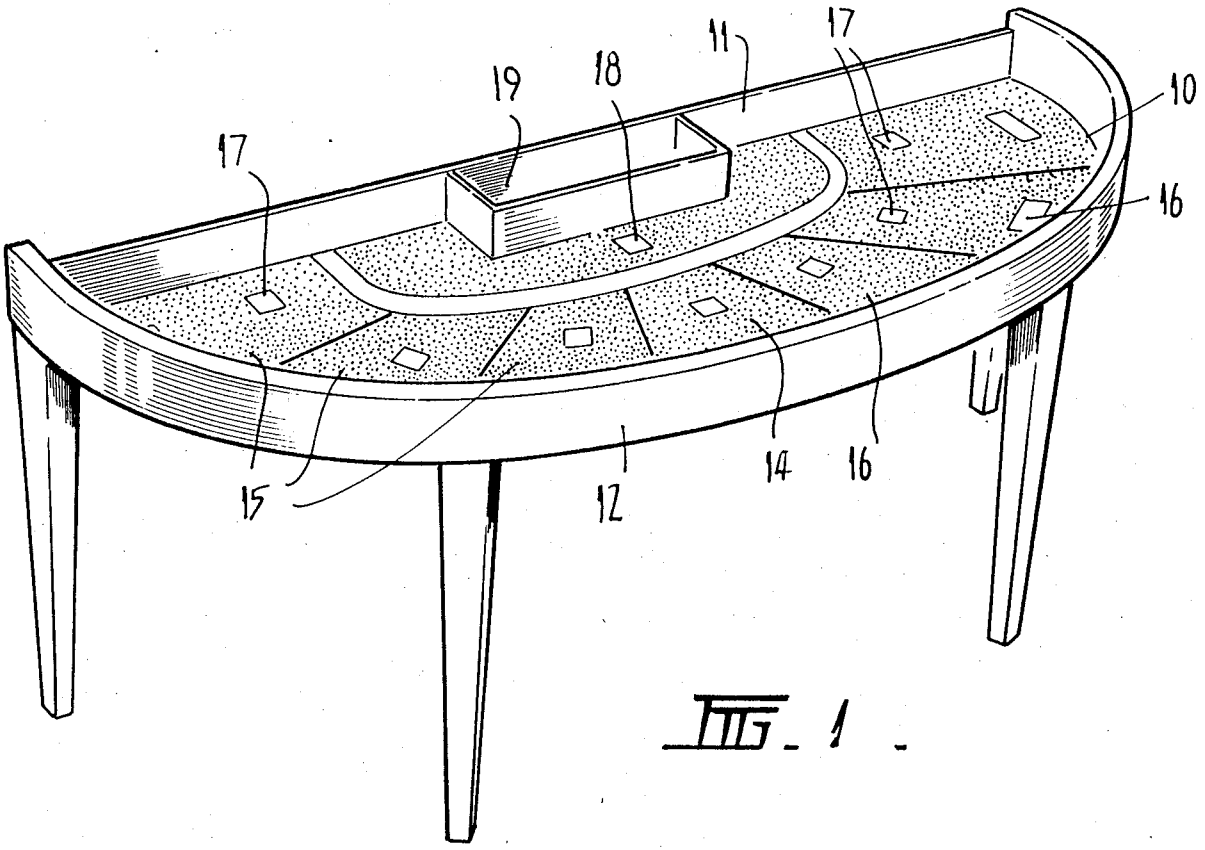
FIG. 1 is a perspective view of the table as it would appear.
Figure 2:
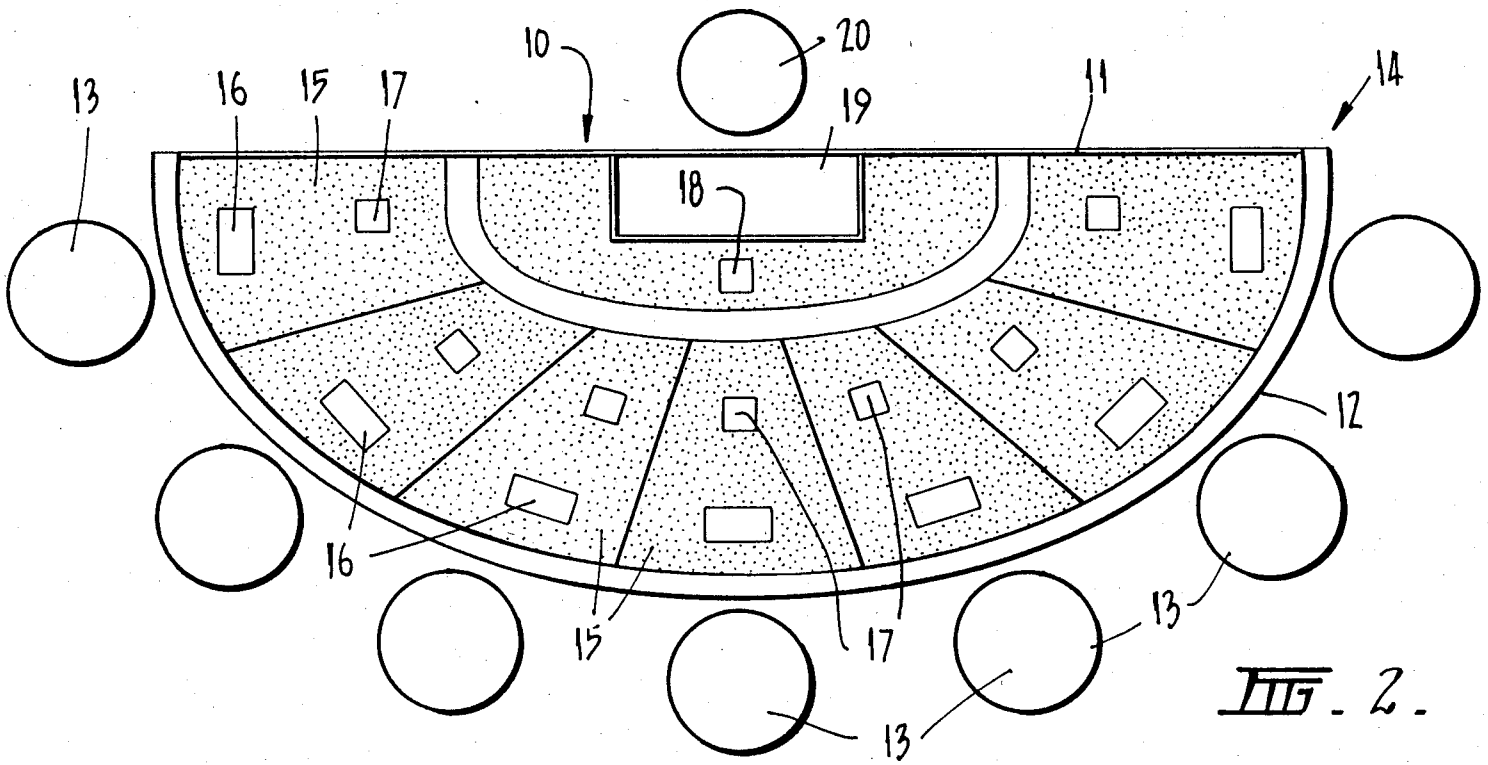
FIG. 2 is a plan view of the table showing the actual arrangement.

The table of FIG. 1 can, in form, be very similar to a Blackjack table and may have a top 10 which has one straight side 11 and a curved portion 12 which comprises the other side and the ends.

The dealer or House 20 sits at the side 11 and the players 13 sit around the curved portion 12.

As illustrated, there are seven player's positions, seven players being the maximum number which can effectively play the game using a single pack of cards.

If a double pack of cards was to be used, the number of players would be able to be increased.

The surface of the table 14 may be formed of felt or the like and each player has located, adjacent his position, a station 15 which comprises an area 16 upon which the cards with which the player is playing are located and a betting placement area 17.

The dealer or House is provided with a card placement area 18 which corresponds to the area 16 of the players and is adapted to receive the dealer's cards and has located in front of him a chips tray 19.

In order to describe the operation of the invention, we shall set out hereinunder the rules of play:

PLAY

The game shall be a game played with a single pack of cards, having a maximum number of eight players, one of these players being the House.

The bank shall either be held by the House or by one of the other players.

For commencement of play, the House shall always be the first bank.

The bank is subsequently offered to all players, the offer passing around the table in an anti-clockwise direction. Each player can take the bank only once per rotation or round and shall play only a single hand as banker. No player shall be obliged to take the bank unless he so desires.

The bank shall also receive the first card.

At commencement, the banker may determine the first card to be dealt by the throwing of two dice and the number of cards equal to the score shown by the dice are removed from the top of the pack and are buried by the dealer.

Alternatively, the cards may be cut after shuffling, as is more conventional. The dealer then commences dealing the game by dealing the first card to the banker, and then to the other players, and himself, one at a time around the table, until every player received a total of four cards.

Each player can then arrange his cards into two pairs, in an endeavour to maximise his score, the scoring being as follows:

1. Where there are two different cards, the cards can be deemed to have their face value up to ten, and the court cards can be deemed to have a value of ten or zero, this having no effect on the score. The two cards are totalled and the score is the unit digit obtained on totalling. Thus, the maximum score from any two cards is nine, which can be made up of a nine and a ten or any court card; an eight and an ace; a seven and a two; a six and a three; or a five and a four. All other combinations must be less than nine. The ace is the highest score card, e.g. an ace and an eight is the highest value; a King and a nine is the second highest, a Queen and a nine is the third highest, etc. down to a five and a four which is the lowest nine.

2. Any pair is treated as being higher than a non-pair combination which adds up to nine and the pairs are treated in order of value from two up to ace, each pair being higher than the preceding pair.

The House shall not play his cards until ALL players (including the banker, if not the House) have played their hands out. The House MUST always play a standard 'House Way' and shall not vary from it. A brief description of the 'House Way' is included hereinafter. In order to win, both pairs of cards in the hand must be higher than the banker's cards, if one pair is higher and one pair is lower, then there is a stand-off and the bet stands and, if both pairs are lower than the banker's pairs, then the banker wins and the bet is lost.

A hand which is constituted of four of a kind beats any other hand except a hand having four of a kind of a higher value than the hand.

Scoring is always the banker's advantage. If the banker and a player have the same cards, e.g. if the banker and a player have the same two pairs, then the banker prevails and the player loses. This also applies when both hands have a total of zero points, then the banker shall also prevail and the player loses.

BETTING

This stakes can be as required by the players and, when the cards are being dealt, they are dealt only to the station 15 of the layout which includes bets in the betting placement areas 17. Betting must be completed before the dice are played or dealing is commenced.

Betting is basically at even money, but when the game is to be played as a casino game, in order for the House to otbain a guaranteed percentage, winning bets are paid at 95% rather than even money, so the House take, overall, is, statistically, 2½% of turnover.

The practical hold percentage could well be greater than this as the House holds the bank for at least a certain number of hands and it has been found, in Blackjack, that, unless good players are playing, the House tends to incrase its hold percentage as the players do not play optimum hands. The same could well apply here.

The banker will, as previously described be either the House or one of the players. If no player wishes to be the banker, the House will be banker.

When a player is banker he MUST cover ALL bets on the table.

It may be desirable to provide a player holding the bank with two options:

1. He can cover the bets himself; or

2. He can cover the bets on a 50/50 basis with the House which is obliged so to do when and if required by the banker. When this occurs, cards must be played the standard 'House Way'.

Where the House is not the banker, it will not play and, thus, will hold no cards. However, the House is obliged to take on a bet laid by the banker up to but no more than the amount of his previous bet as a player.

In this specification, we have made reference to the 'House Way' of arranging a hand.

This may be relatively specific, but for the purposes of this description, the 'House Way' can be stated to have three rules.

The main rule is that the House will, under normal circumstances, even its hands out so that the two hands have scores which are as close to the same as possible.

For example, if the House's cards are ten, eight, seven and six, then the hands it would play would be eight and seven, which gives an effective total of five and ten and six, which gives a total of six. It would not play six and seven, which gives a total of three and ten and eight which gives a total of eight.

In this way the House is effectively trying to play for a stand-off rather than necessarily a winning hand.

The exceptions are that, when the Houe can make a nine, either the highest nine, from an ace and an eight, or the second highest nine, from a King and a nine, it plays this pair and whatever other pair it has, rather than make an average hand as described as the general rule.

The other exception is that pairs are played as pairs, except in certain circumstances.

A pair of twos is only split when the other cards include two of fives, sixes or sevens; threes are only split when the other cards are a four and six or a five and six; sevens are only split when the other two cards are an ace and a ten or a court card or an ace and a two, eights are only split when the other cards are an ace and a ten or a court card; nines are only split where both the other cards are a ten or a court card and aces are only split when the other two cards are a six and a seven, a six and an eight, or a seven and an eight.

Pairs of fours, fives, sixes, tens, Jacks and Queens are never split.

It will be appreciated that these rules are somewhat arbitrary, but can readily be recalled by players, to ensure that the House is playing correctly and ensure that the hands of the game are as satisfactory as possible.

We claim:

1. A card game for a number of players in which each player and the bank is dealt four cards which the player has to make into two groups of two having a highest value, the value being achieved either by adding the face value of the cards, with the court cards having a nominated face value of ten, and disregarding the ten digit should there be one, each player playing against the bank, the player having a winning hand, if both of his pairs are higher than both of the bank pairs, a losing hand, if both of his pairs are lower than both of the bank pairs, and reaching a stand-off if one pair is lower and one pair higher than both of the bank pairs.

2. A card game as claimed in claim 1 wherein the bank may be either the House or one of the players.

3. A card game as claimed in claim 2 wherein the House is the first banker and subsequently the other players, in turn, are given the option of taking the bank.

4. A card game as claimed in claim 3 wherein, if the House is not the banker, the banker can request the House cover half any bets made.

5. A card game comprising a table having a playing surface, a plurality of stations on the surface and about the periphery of the table for the players and a separate station located substantially centrally of the plurality of stations for a dealer, each station other than the dealer's station having an area upon which the player's cards are to be located and a betting placement area and the station at which the dealer is located having an area upon which the cards to be played by the dealer can be located and a tray to receive betting chips, the game being one in which each player and the bank is dealt four cards which the player has to make into two groups of two having a highest value, the value being achieved either by adding the face value of the cards, with the court cards having a nominated face value of ten and disregarding the ten digit card should there be one, each player playing against the bank, the player having a winning hand if both of his pairs are higher than both of the bank pairs, a losing hand if both of his pairs are lower than both of the bank pairs, and reaching a stand-off if one pair is lower and one pair higher than both of the bank pairs.

6. A card game as claimed in claim 5 wherein the bank may be the House or another player.

7. A card game as claimed in claim 6 wherein the House is the first banker and subsequently the other players, in turn, are given the option of taking the bank.

8. A card game as claimed in claim 7 wherein, if the House is not the banker, the banker can request the House cover half of any bets made.

* * * * *